US007721711B2

(12) United States Patent
Kurosawa et al.

(10) Patent No.: US 7,721,711 B2
(45) Date of Patent: May 25, 2010

(54) ENGINE CONTROL SYSTEM INCLUDING MEANS FOR LEARNING CHARACTERISTICS OF INDIVIDUAL FUEL INJECTORS

(75) Inventors: Masanori Kurosawa, Sunto-gun (JP); Masaei Nozawa, Okazaki (JP)

(73) Assignee: DENSO Corporation, Kariya (JP)

( * ) Notice: Subject to any disclaimer, the term of this patent is extended or adjusted under 35 U.S.C. 154(b) by 3 days.

(21) Appl. No.: 11/935,551

(22) Filed: Nov. 6, 2007

(65) Prior Publication Data

US 2008/0121213 A1 May 29, 2008

(30) Foreign Application Priority Data

Nov. 24, 2006 (JP) ..... 2006-316505

(51) Int. Cl.
*F02M 1/00* (2006.01)
*B60T 7/12* (2006.01)

(52) U.S. Cl. ..... 123/434; 123/673; 123/691; 701/103

(58) Field of Classification Search ..... 123/434, 123/478, 480, 488, 673, 691, 692; 701/103, 701/104

See application file for complete search history.

(56) References Cited

U.S. PATENT DOCUMENTS 5,752,492 A * 5/1998 Kato et al. ..... 123/674
5,848,527 A * 12/1998 Mitsutani ..... 60/274
5,979,419 A * 11/1999 Toyoda ..... 123/520
6,032,659 A * 3/2000 Yamashita et al. ..... 123/674
6,186,131 B1 * 2/2001 Mitsutani et al. ..... 123/687
7,024,302 B2 * 4/2006 Mizuno et al. ..... 701/109
7,051,725 B2 * 5/2006 Ikemoto et al. ..... 123/673
2005/0022797 A1 * 2/2005 Ikemoto et al. ..... 123/673
2005/0075781 A1 * 4/2005 Mizuno et al. ..... 701/109

FOREIGN PATENT DOCUMENTS

JP 2-78750 3/1990

* cited by examiner

*Primary Examiner*—John T Kwon
(74) *Attorney, Agent, or Firm*—Nixon & Vanderhye P.C.

(57) ABSTRACT

An engine control system includes an fuel injector for each cylinder of the engine, an air-fuel ratio sensor disposed in an exhaust manifold and an electronic control unit to which signals from various sensors are fed. Operation of the engine is controlled by the electronic control unit. An air-fuel ratio deviation among cylinders is calculated based on output signals of the air-fuel ratio sensor, and injection amount errors of each injector are calculated from the deviation of air-fuel ratio among cylinders. An injection characteristic of each injector is learned from the injection amount errors, and a right amount of fuel is supplied to each cylinder based on the learned injection characteristic. In this manner, the injection amount errors are effectively adjusted, and the air-fuel ratio deviation among cylinders due to external disturbances is surely adjusted.

8 Claims, 5 Drawing Sheets

ENGINE CONTROL SYSTEM INCLUDING MEANS FOR LEARNING CHARACTERISTICS OF INDIVIDUAL FUEL INJECTORS

CROSS-REFERENCE TO RELATED APPLICATION

This application is based upon and claims benefit of priority of Japanese Patent Application No. 2006-316505 filed on Nov. 24, 2006, the content of which is incorporated herein by reference.

BACKGROUND OF THE INVENTION

1. Field of the Invention

The present invention relates to an engine control system, in which injection characteristics of individual fuel injectors are learned and an amount of fuel injected from individual fuel injector is controlled based on the injection characteristics.

2. Description of Related Art

Recently, some proposals have been made for improving detection accuracy of an air-fuel ratio in an internal combustion engine. For example, JP-A-2005-207405 proposes the following system: an air-fuel ratio of each cylinder is estimated based on output signals of an air-fuel ratio sensor disposed in an exhaust pipe at a position where exhaust gas streams from plural cylinders merge; an air-fuel ratio deviation among cylinders is calculated; an mount for adjusting the air-fuel ratio of each cylinder is calculated to minimize the air-fuel ratio deviation among cylinders; and the air-fuel ratio of each cylinder is controlled using the calculated amount for adjusting the air-fuel ratio.

On the other hand, JP-A-2-78750 proposes the following system: a target amount of fuel injection for each cylinder and an average amount of fuel injection among all cylinders are calculated based on operating conditions of an engine when the engine is idling; the injection amount for each cylinder is adjusted using a difference between the target amount and the average amount; and thus the average amount of fuel injection for all cylinders converges to the target amount.

As shown in FIG. 3 attached hereto, an injection characteristic (an amount of injected fuel versus time period in which fuel is injected) of an individual injector is not the same as the standard injection characteristic. This means that a certain error (deviation) in the injection amount relative to the standard amount cannot be avoided. The error (deviation) may depend on original individuality of each injector, or it may be caused in a course of actual usage.

Since the deviation from the standard characteristic is unavoidable for each injector, the air-fuel ratio deviation among cylinders cannot be precisely detected in the system disclosed in JP-A-2005-207405. This is because an influence of the injection amount error of each injector is included in the deviation of air-fuel ratio among cylinders. Accordingly, the air-fuel ratio deviation among cylinders due to external disturbances, such as introduction of evaporated gas or a blow-by gas into an intake system, is not accurately detected.

In the system disclosed in JP-A-2-78750, the average amount of fuel injection for all cylinders is converged to a target amount if there is a deviation in the fuel amount injected from each injector in the idling state. However, the error in the injection amount of each injector due to the injection characteristic deviation cannot be adjusted.

SUMMARY OF THE INVENTION

The present invention has been made in view of the above-mentioned problems, and an object of the present invention is to provide an improved system for controlling operation of an internal combustion engine, in which an error in an amount of fuel injected from each injector due to an injection characteristic deviation among individual injectors is effectively adjusted.

The engine control system of the present invention includes a fuel injector for each cylinder of the engine, an air-fuel ratio sensor disposed in an exhaust manifold at a position where exhaust pipes of all cylinders merge, and an electronic control unit that controls operation of the engine based on signals inputted from various sensors.

An air-fuel ratio deviation among cylinders is detected based on output signals of the air-fuel ratio sensor in reference to a model for estimating an air-fuel ratio of each cylinder. An injection amount error (a deviation from a standard amount) of each fuel injector is detected based on the air-fuel ratio deviation among cylinders. The injection amount errors are detected when the engine is stably operating under a heavy load and under a light load (such as idling). An injection characteristic (i.e., a relation between an injection amount and a injection time period) of each fuel injector is learned from the injection amount errors of each fuel injector.

The injection amount errors are accurately adjusted based on the leaned injection characteristic of each fuel injector, and a deviation of air-fuel ratio among cylinders caused by external disturbances, such as introduction of evaporated gas or blow-by gas into an intake system, is effectively adjusted.

Other objects and features of the present invention will become more readily apparent from a better understanding of the preferred embodiment described below with reference to the following drawings.

DETAILED DESCRIPTION OF THE PREFERRED EMBODIMENT

Figure 1:
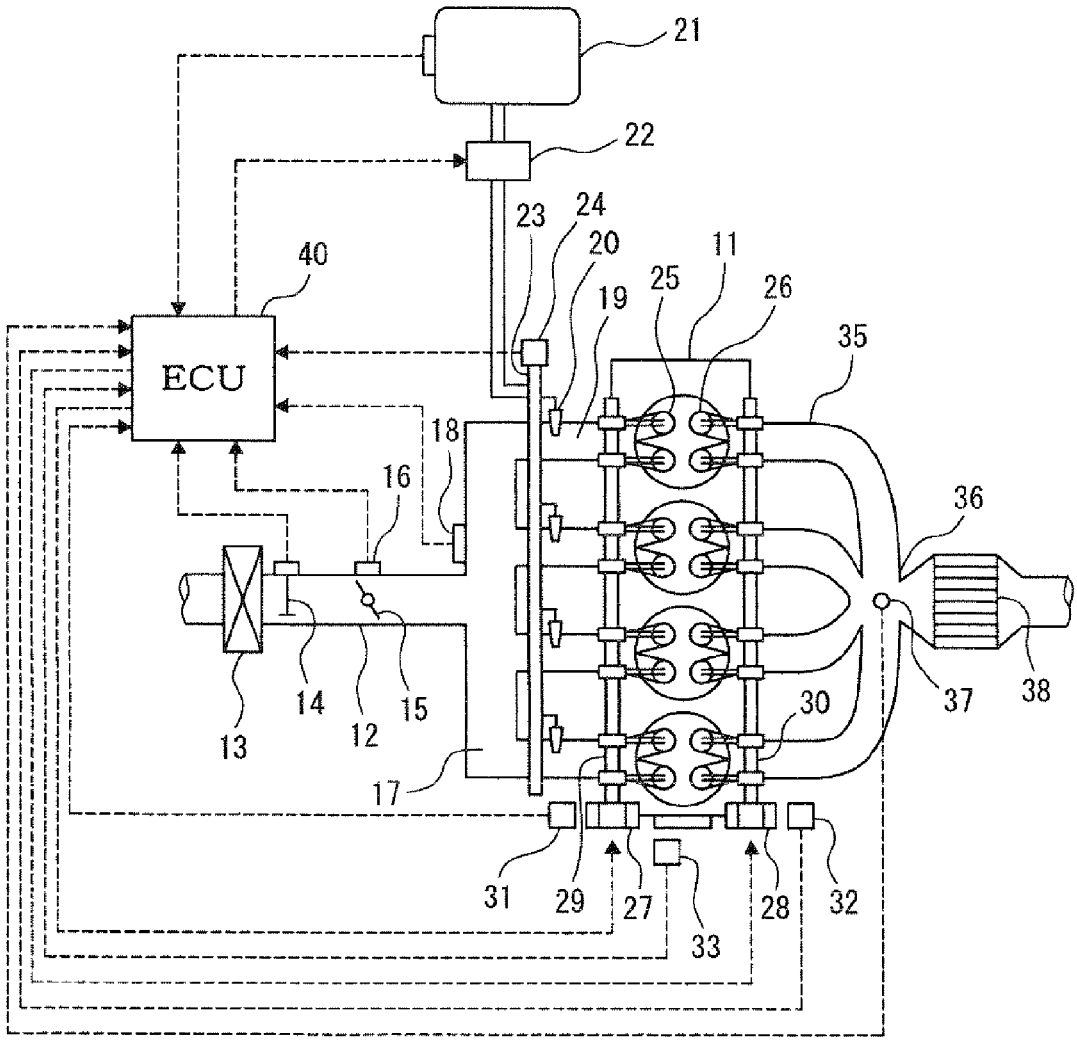
FIG. 1 is a drawing showing an entire structure of an engine control system according to the present invention.

A preferred embodiment of the present invention will be described with reference to accompanying drawings. First, an entire structure of an engine control system according to the present invention will be described with reference to FIG. 1. An internal combustion engine 11 having four cylinders in line is shown in FIG. 1 as an example. An air cleaner 13 is disposed at an upstream end of an intake pipe 12 of the engine 11. An airflow meter 14 for detecting an amount of intake air is disposed downstream of the air cleaner 13 in the intake pipe 12. A throttle valve 15 driven by an actuator such as a motor and a throttle sensor 16 for detecting an opening degree of the throttle valve 15 are disposed downstream of the airflow meter 14.

A surge tank 17 is connected to a downstream end of the intake pipe 12, and an intake air pressure sensor 10 for detecting a pressure in the intake pipe 12 is mounted to the surge tank 17. An intake manifold 19 for supplying air to each cylinder of the engine 11 is connected to the surge tank 17. A fuel injector 20 is disposed in each branch of the intake manifold 19 at a position close to an intake port. When the engine is in operation, fuel contained in a fuel tank 21 is fed into a delivery pipe 23, and fuel in the delivery pipe 23 is injected from the injector 20 into each cylinder of the engine 11 in a controlled manner. A fuel pressure sensor 24 is installed to the delivery pipe 23.

A mechanism 27 for varying opening and closing timing of an intake valve 25 and a mechanism 28 for varying opening and closing timing of an exhaust valve 26 are installed to the engine 11. An intake camshaft 29 driving the intake valves 25 and an exhaust camshaft 30 driving the exhaust valves 26 are also installed to the engine 11. A sensor 31 for detecting a rotational angle of the intake camshaft 29 and a sensor 32 for detecting a rotational angle of the exhaust camshaft 30 are installed to the engine 11. A crank angle sensor 33 is also installed to the engine 11. The crank angle sensor 33 outputs a pulse signal every predetermined rotational angle (for example, 30 degrees) of a crankshaft of the engine 11.

An air-fuel ratio sensor 37 is disposed in an exhaust manifold 35 at a position 36 where exhaust pipes connected to respective cylinders merge. A three-way catalyst for purifying exhaust gas components such as CO, HC and NOx is disposed downstream of the air-fuel ratio sensor 37.

Output signals of the air-fuel ratio sensor 37 and other sensors mentioned above are inputted to an engine control unit 40 (referred to as ECU). The ECU 40 including a microcomputer performs engine control programs stored in a ROM in the ECU 40, and an amount of fuel supplied to each cylinder and ignition timing is controlled according to operating conditions of the engine.

The ECU 40 also performs a process of controlling an air-fuel ratio of each cylinder shown in FIG. 4 (which will be explained later in detail). In this process, the air-fuel ratio of each cylinder is estimated based on output signals of the air-fuel ratio sensor 37 and a model for estimating an air-fuel ratio of each cylinder. In this model, a relation between the air-fuel ratio of each cylinder and the output signal of the air-flow sensor 37 is defined. A deviation of the estimated air-fuel ratio of each cylinder from a standard air-fuel ratio is calculated, and an air-fuel ratio deviation among cylinders is calculated. An air-fuel ratio adjustment factor for each cylinder is calculated so that the air-fuel ration deviation among cylinders is minimized. An amount of fuel supplied to each cylinder is adjusted using the air-fuel ratio adjustment factor, and thus the air-fuel ratio deviation among cylinders is controlled to minimize the same.

The air-fuel ratio deviation among cylinders is detected when the operating conditions of the engine is steady and transient. It may be also detected when evaporated gas or blow-by gas is being introduced into the engine or when other adjustment operation is being performed if the influence of such operations on the air-fuel ration deviation is detectable.

Figure 3:
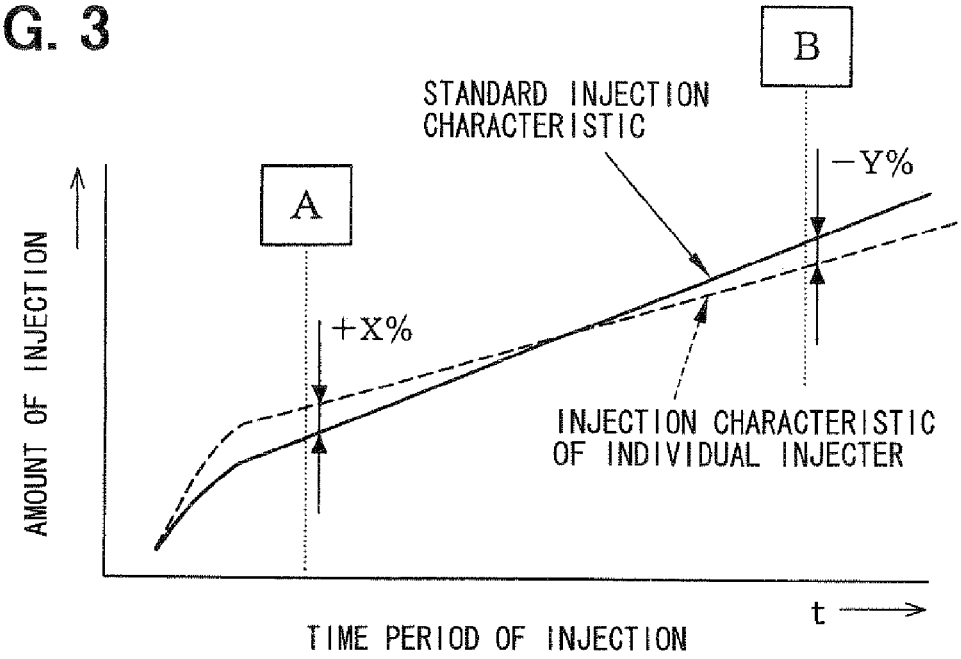
FIG. 3 is a graph showing an injection characteristic (relation between injection time and an amount of injected fuel) of a standard injector and an actual injector.

FIG. 3 shows an injection characteristic of a standard fuel injector (referred to as a standard injection characteristic) and an injection characteristic of an actual injector. The standard injection characteristic is shown with a solid line and that of an actual injector with a dotted line. As seen in the graph, an amount of injected fuel of the actual injector differs from that of the standard injector even when a period of time in which fuel is injected (referred to as injection time period) is equal for both injectors. Such a difference, or a deviation, is caused by individuality of the injectors (i.e., an original difference among individual injectors), or actual use of the injector.

Since an individual injector includes a deviation from the standard injection characteristic, it is difficult to accurately calculate an air-fuel ratio deviation among cylinders based on output signals of the air-fuel ratio sensor 37. This is because the deviation in injection amount of each injector is included in the air-fuel ratio deviation among cylinders. For example, influence of an external disturbance, such as introduction of evaporated gas or blow-by gas into the cylinder, on the air-fuel ratio deviation among cylinders cannot be detected. Accordingly, the air-fuel ratio adjustment factor for each cylinder cannot be accurately calculated, and therefore the air-fuel ratio deviation among cylinders caused by the external disturbance cannot be accurately adjusted.

Figure 6:
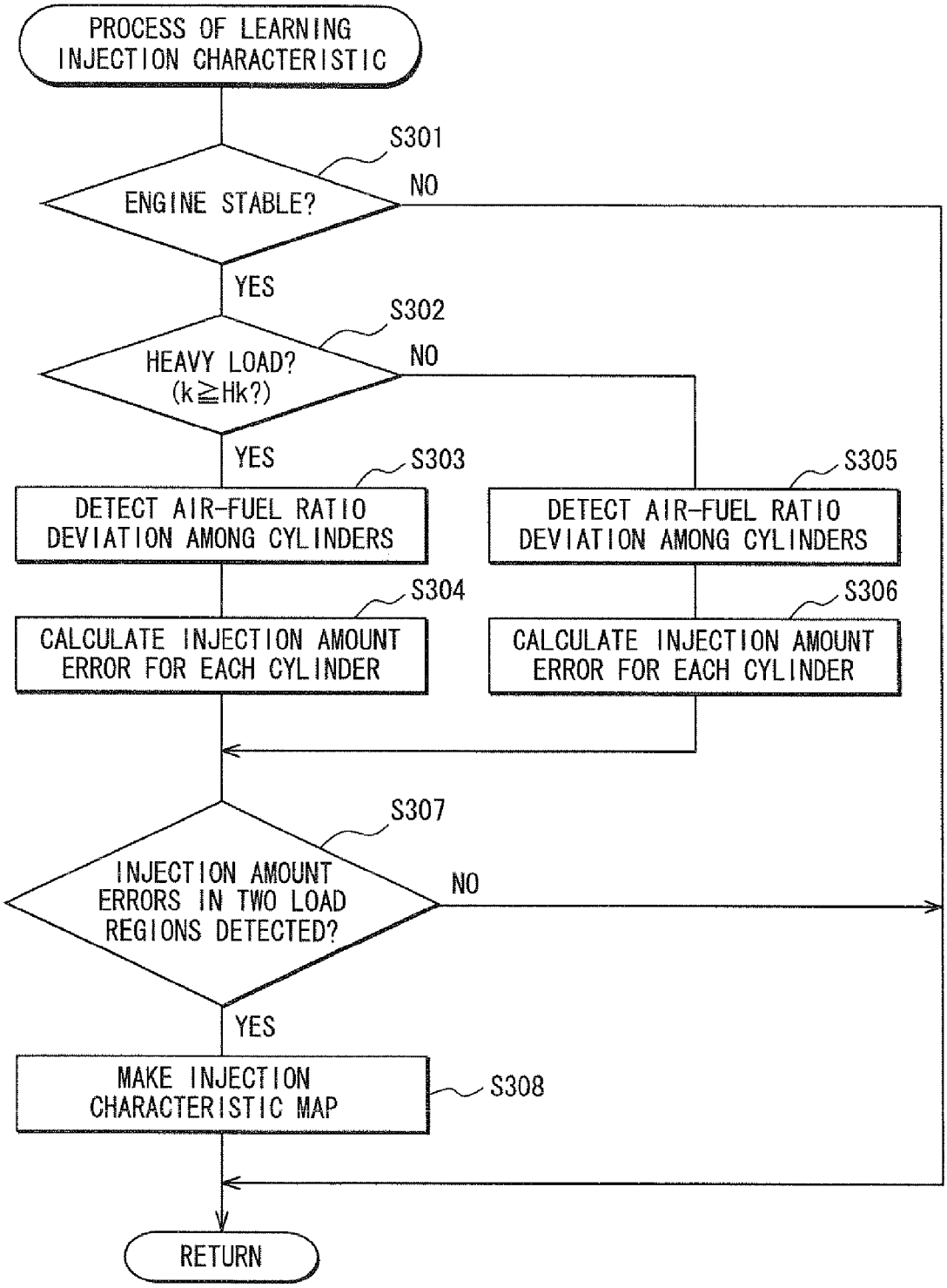
FIG. 6 is a flowchart showing a process of learning an injection characteristic.

To cope with the problem caused by the injection characteristic difference among injectors, a process of learning the injection characteristic shown in FIG. 6 is employed in the present invention. More particularly, the air-fuel ratio deviation among cylinders is detected based on the output signals of the air-fuel ratio sensor 37 when the engine is stably operated under a heavy load and a low load. The air-fuel ratio adjustment factor for each cylinder is calculated to minimize the air-fuel ratio deviation among cylinders, and an injection amount error (a deviation from a standard amount) of each injector is adjusted in the following manner.

Figure 2:
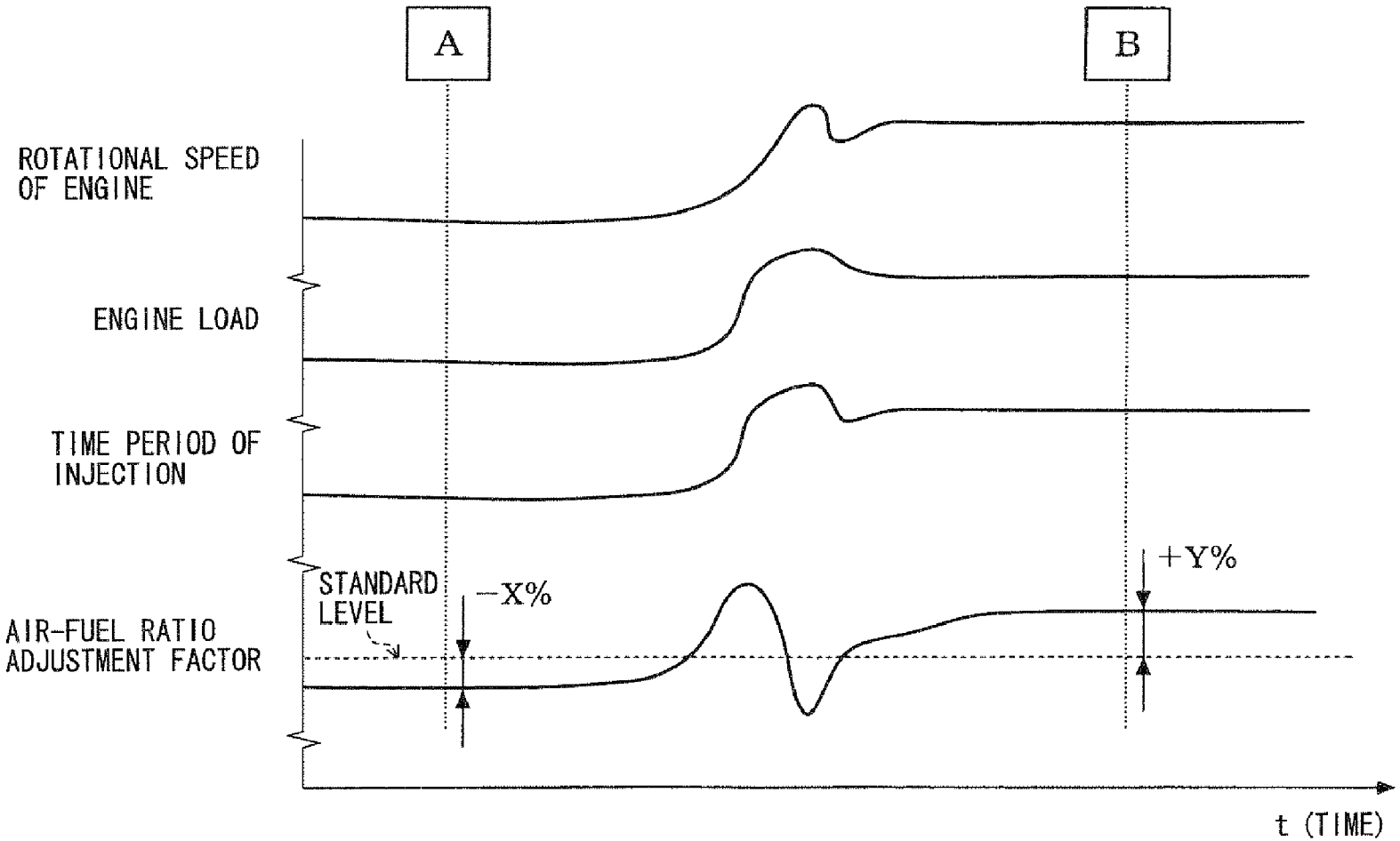
FIG. 2 is a time-chart for explaining an air-fuel ratio adjustment factor that changes according to operating conditions of an engine.

If an injection amount error (or a deviation from the standard amount) is at a plus side (+X %) as shown at "A" in FIG. 3, the air-fuel ratio adjustment factor has to be at an minus side (−X % from a standard level set to 1.0) as shown at "A" in FIG. 2. If an injection amount error is at a minus side (−Y %) as shown at "B" in FIG. 3, the air-fuel ratio adjustment factor has to be at a plus side (+Y % from a standard level set to 1.0) as shown at "B" in FIG. 2. In other words, when the air-fuel ratio adjustment factor decreases by X %, the injection amount error is calculated as +X %. When the air-fuel ratio adjustment factor increases by Y %, the injection amount error is calculated as Y %. Since the injection characteristic is substantially linear as shown in FIG. 3, a whole characteristic can be estimated if the injection amount errors are determined at two points, as shown with "A" and "B" in FIG. 3.

After estimating the injection characteristic of each injector 20 in the manner described above, it is memorized in a non-volatile rewritable memory such as a backup RAM in the ECU 40. Thus, the injection characteristic of each injector 20 is learned. An injection time period of each injector corresponding to a required injection amount is set in reference to the injection characteristic learned and stored in the memory. In this manner, the injection amount error of each injector due to the individuality of the injection characteristic can be adjusted in an almost entire region of the engine operating conditions.

The air-fuel ratio deviation among cylinders is detected only when the engine is stably operated. It is also possible to detect the air-fuel ratio deviation among cylinders under special conditions, i.e., when evaporated gas or blow-by gas is being introduced into the intake system or other adjusting control is being performed, if an amount of changes in the air-fuel ratio due to such special conditions is detectable.

Figure 4:
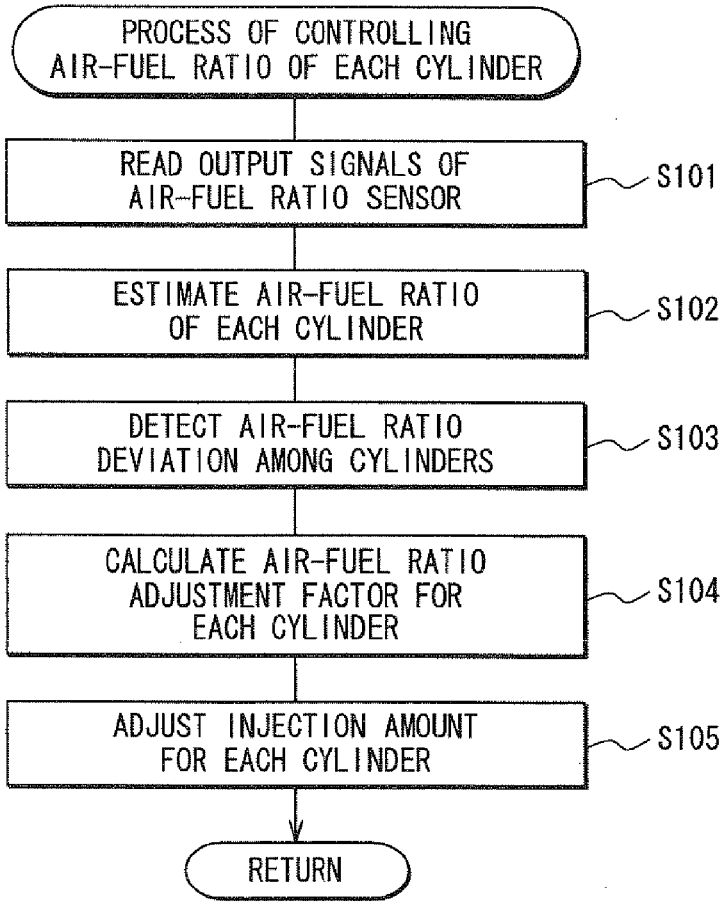
FIG. 4 is a flowchart showing a process of controlling an air-fuel ratio of each cylinder.

With reference to FIG. 4, a process of controlling the air-fuel ratio of each cylinder will be described. This process is performed periodically when power is supplied to the ECU 40. At step S101, the output signals of the air-fuel ratio sensor 37 are read. At step S102, the air-fuel ratio of each cylinder is estimated based on the output signals of the air-fuel ratio sensor 37 and in reference to the model for estimating the air-fuel ratio of each cylinder. Then, at step S103, a difference between the estimated air-fuel ratio of each cylinder and an average air-fuel ration of all cylinders or a target air-fuel ratio is calculated, and thereby the air-fuel ratio deviation among cylinders is calculated. Then, at step S104, the air-fuel ratio adjusting factor for each cylinder is calculated so that the air-fuel ratio among cylinders is minimized. At step S105, the injection amount of each cylinder is adjusted using the calculated air-fuel ratio adjustment factor. Thus, the air-fuel ratio deviation among cylinders is decreased.

Figure 5:
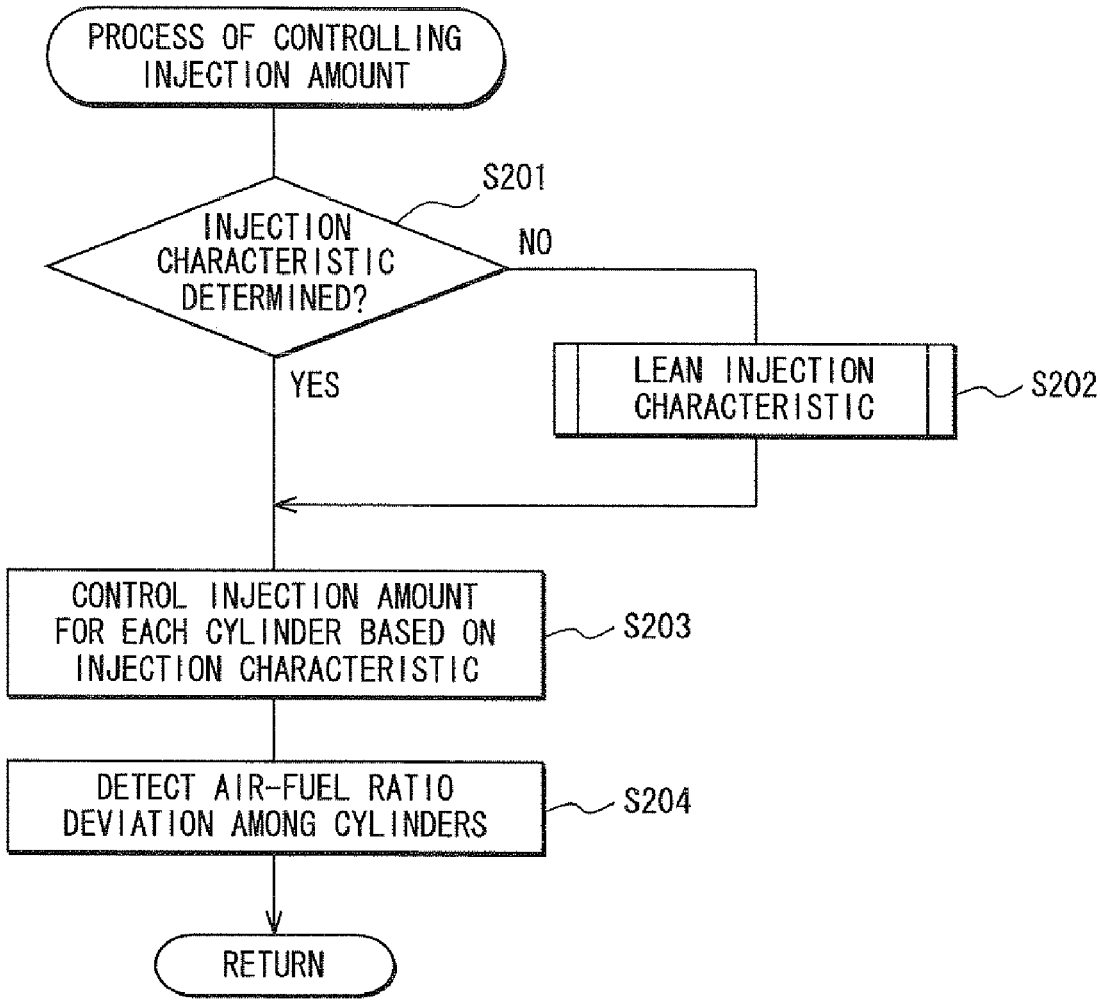
FIG. 5 is a flowchart showing a process of controlling an amount of injected fuel.

With reference to FIG. 5, a process of controlling the injection amount (an amount of fuel injected from an injector) will be described. This process is performed periodically when the ECU is in operation. At step S201, whether the injection characteristic of each injector is memorized or not is determined. If the injection characteristic of each injector is not memorized, the process proceeds to step S202, where the injection characteristic of each injector is learned in a process shown in FIG. 6 (which will be explained later in detail). If the injection characteristic is memorized, the process proceeds to step S203, where the injection time period corresponding to a required amount of fuel for each cylinder is set in reference to the injection characteristic. Each injector is controlled using the injection time period thus set. Then, the process proceeds to step S204, where the air-fuel ratio of each cylinder is estimated based on the output signals of the air-fuel ratio sensor 37 in reference to the model for estimating an air-fuel ratio of each cylinder, and the air-fuel ratio among cylinders is calculated.

The process of learning the injection characteristic will be described with reference to FIG. 6. This process is performed as a step S202 shown in FIG. 5 as explained above. At step S301, whether the engine is stably operated or not is determined based on rotational speed of the engine and an engine load. If it is determined at step S301 that the engine is not stably operated, the process directly comes to the end without performing other steps in this process. If the engine is stably operated, the process proceeds to step S302, where whether the engine load is heavy or not is determined. For example, it is determined that the engine load is heavy if the engine load k is equal to or higher than a predetermined load Hk. The engine load may be represented by an amount of intake air or a pressure in the intake pipe.

If the engine load is heavy, the process proceeds to step S303, where the air-fuel ratio deviation among cylinders is calculated in the manner described above. Then, at step S304, the air-fuel ratio adjustment factor for each cylinder under the heavy load condition is calculated so that the air-fuel ratio deviation among cylinders is minimized. The injection amount error of each injector is calculated based on the air-fuel ratio adjustment factor of each injector. On the other hand, if it is determined that the engine load is low (e.g., under an idling condition), the process proceeds to step S305, where the air-fuel ratio deviation among cylinders is calculated. Then, at step S306, the air-fuel ratio adjustment factor for each cylinder under the low load condition is calculated so that the air-fuel ratio deviation among cylinders is minimized. The injection amount error of each injector is calculated based on the air-fuel ratio adjusting factor of each injector.

Then, the process proceeds to step S307, where whether the injection amount errors under both of the heavy load condition and the low load condition are detected or not is determined. If it is determined that the injection amount errors under both conditions are detected, the process proceeds step S308, the injection characteristic of each injector is determined from the injection amount errors detected and the injection time period corresponding to such injection amount errors (refer to FIG. 3). The injection characteristic of each injector is memorized in a memory such as a backup RAM in the ECU 40. Thus, the process of learning the injection characteristic is completed.

As described above, the injection amount error of each cylinder (or each injector) is calculated based on the air-fuel ratio deviation among cylinders. The injection amount errors are detected under both of the heavy and low load conditions. The injection characteristic of each injector is learned based on the detected injection amount errors. The fuel injectors are controlled based on the learned injection characteristics. Therefore, the injection errors are corrected in an almost entire region of operating conditions of the engine. The influence of the external disturbances, such as introduction of evaporated gas or blow-by gas into the intake system, on the air-fuel ratio deviation among cylinders is accurately detected. Accordingly, the air-fuel ratio adjustment factor is accurately calculated, and changes in the air-fuel ratio among cylinders due to the external disturbance are precisely adjusted.

When the engine is stably operated, the air-fuel ratio of each cylinder is stable and the air-fuel ratio deviation among cylinders precisely reflects the injection amount errors of each injector. Based on this fact, the injection characteristic of each injector is learned under the stable operating conditions of the engine. In addition, in learning the injection characteristic, injection amount errors detected at two points (heavy load and low load conditions of the engine), which are apart certain distance from each other, are used. Therefore, the injection characteristic can be learned with a high accuracy.

The present invention is not limited to the embodiment described above, but it may be variously modified. For example, the injection characteristic may be learned by using the injection amount errors under three or more operating conditions of the engine. Though the air-fuel ratio of each cylinder is estimated based on the output signals of the air-fuel ratio sensor 37 in reference to the model for estimating the air-fuel ratio in the embodiment described above, the air-fuel ratio of each cylinder may be estimated or detected by other methods. For example, it may be estimated based on the outputs of the air-fuel ratio sensor 37 when a dither control of the air-fuel ratio is performed, i.e., when the air-fuel ratio is forcibly changed. Though a four-cylinder engine is controlled in the embodiment described above, other engines such as two-cylinder engine, three-cylinder engine, or engines having five or more cylinders may be controlled according to the present invention.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A system for controlling an internal combustion engine, comprising:

a fuel injector for supplying fuel to each cylinder of the internal combustion engine;

an air-fuel ratio sensor disposed in an exhaust manifold at a position where exhaust pipes of each cylinder merge;

means for detecting an air-fuel ratio deviation among cylinders based on output signals of the air-fuel ratio sensor;

means for learning an injection characteristic of each fuel injector based on the air-fuel ratio deviation among cylinders detected under plural operating conditions of the internal combustion engine, the injection characteristic being a relationship between an injection amount and an injection time period; and means for controlling an amount of fuel injected from each fuel injector based on the injection characteristic of each fuel injector.

2. The system for controlling an internal combustion engine as in claim 1, wherein:

learning means learns the injection characteristic of each fuel injector when the operating conditions of the engine are stable.

3. The system for controlling an internal combustion engine as in claim 2, wherein:

the injection characteristic of each fuel injector is learned when the engine is operated under a heavy load and under a low load.

4. A system for controlling an internal combustion engine, comprising:

a fuel injector for supplying fuel to each cylinder of the internal combustion engine;

an air-fuel ratio sensor disposed in an exhaust manifold at a position where exhaust pipes of each cylinder merge;

means for detecting an air-fuel ratio deviation among cylinders based on output signals of the air-fuel ratio sensor;

means for learning an injection characteristic of each fuel injector based on the air-fuel ratio deviation among cylinders detected under plural operating conditions of the internal combustion engine, the injection characteristic being a relationship between an injection amount and an injection time period; and means for controlling an amount of fuel injected from each fuel injector based on the injection characteristic of each fuel injector; wherein the air-fuel ratio deviation among cylinders is detected based on the output signals of the air-fuel ratio sensor which are obtained after the amount of fuel injected from each fuel injector is adjusted based on the injection characteristic of each fuel injector learned by the learning means.

5. A method of controlling an amount of fuel supplied from a fuel injector to each cylinder of an internal combustion engine, the method comprising:

detecting an air-fuel ratio deviation among cylinders of the engine based on output signals of an air-fuel ratio sensor disposed in an exhaust manifold of the engine;

learning an injection characteristic of each fuel injector based on the air-fuel ratio deviation among cylinders, which are detected under plural operating conditions of the engine, the injection characteristic being a relationship between an injection amount and an injection time period; and controlling an amount of fuel injected from each fuel injector based on the injection characteristic of each fuel injector.

6. The method as in claim 5, wherein:

the injection characteristic of each fuel injector is learned when the operating conditions of the engine are stable.

7. The method as in claim 6, wherein:

the injection characteristic of each fuel injector is learned when the engine is operated under a heavy load and under a low load.

8. A method of controlling an amount of fuel supplied from a fuel injector to each cylinder of an internal combustion engine, the method comprising:

detecting an air-fuel ratio deviation among cylinders of the engine based on output signals of an air-fuel ratio sensor disposed in an exhaust manifold of the engine;

learning an injection characteristic of each fuel injector based on the air-fuel ratio deviation among cylinders, which are detected under plural operating conditions of the engine, the injection characteristic being a relationship between an injection amount and an injection time period; and controlling an amount of fuel injected from each fuel injector based on the injection characteristic of each fuel injector;

wherein the air-fuel ratio deviation among cylinders is detected based on the output signals of the air-fuel ratio sensor which are obtained after the amount of fuel injected from each fuel injector is adjusted based on the learned injection characteristic of each fuel injector.

* * * * *